US006821260B2

(12) United States Patent
Fors

(10) Patent No.: US 6,821,260 B2
(45) Date of Patent: Nov. 23, 2004

(54) MYOFASCIAL REHABILITATION BOARD AND METHOD OF USE

(76) Inventor: Gregory Charles Fors, 1955 130$^{th}$ Ave., Mora, MN (US) 55051

( * ) Notice: Subject to any disclaimer, the term of this patent is extended or adjusted under 35 U.S.C. 154(b) by 160 days.

(21) Appl. No.: 10/289,846

(22) Filed: Nov. 7, 2002

(65) Prior Publication Data

US 2004/0092850 A1 May 13, 2004

(51) Int. Cl.$^{7}$ ..... A61H 7/00; A61H 39/04

(52) U.S. Cl. ..... 601/133; 601/134; 601/115; 601/122; 606/204

(58) Field of Search ..... 601/22, 23, 27, 601/28, 29, 133, 134, 135, 136, 115, 122; 606/204; D24/211; 273/148 A; 434/211, 214, 216

(56) References Cited

U.S. PATENT DOCUMENTS 2,836,175 A * 5/1958 Nakayama ..... 601/135
4,233,966 A * 11/1980 Takahashi ..... 601/134
5,067,902 A * 11/1991 Phillips ..... 434/276
5,096,188 A * 3/1992 Shen ..... 601/134
5,820,573 A * 10/1998 Ramos ..... 601/134
5,899,868 A * 5/1999 VandeBerg ..... 601/134
5,913,839 A * 6/1999 Wincek ..... 601/134
D413,985 S * 9/1999 Martin et al. ..... D24/211
6,013,042 A * 1/2000 Sakai ..... 601/134

* cited by examiner

*Primary Examiner*—Danton D. DeMille
*Assistant Examiner*—Quang D. Thanh
(74) *Attorney, Agent, or Firm*—N Paul Friederichs

(57) ABSTRACT

A myofascial rehabilitation device, including a board defining a handle and bores therein, the bores being of predetermined diameter ranging between ¼" to 1½", the bores being of a predetermined orientation, ranging from 30° 90° relative to a surface of the board; projections having ends, a first end of each projection being selectively engageable with the bores, the projections being of predetermined diameters ranging in from ¼" to 1½" and ranging in length from one inch to four inches; tips being sized to snugly receive a second end of the projections; and mechanism for retaining the projections when the projections are disengaged from the board and a method of use including the steps of stretching tissue to be treated to the point of discomfort; arranging at least one projection on a myofascial rehabilitation board; relaxing against the board such that the projection applies pressure on a trigger point, such pressure to be applied until there is tolerable discomfort, while avoiding tensing of the tissue; applying more pressure as local and referral discomfort abates to maintain mild referral discomfort; and ceasing when the referral discomfort abates and the trigger point releases.

7 Claims, 1 Drawing Sheet

MYOFASCIAL REHABILITATION BOARD AND METHOD OF USE

BACKGROUND OF THE INVENTION

The present invention relates to devices and therapies for use in neuromuscular care and more specifically to devices and therapies used to apply ischemic compression therapies to myofascial tissue affected by trigger points.

Health care professionals have learned that myofascial tissue in any part of the body can cause local pain and tenderness as well as referral pain to other parts of the body. For instance, a patient may have a focus of hyper-irritable tissue in muscles, fascia or ligaments along the cervical spine and the patient feels pain and tenderness in the neck with pain referring into the head or down into the shoulder and arm. This focus of irritable tissue is referred to as a myofascial trigger point. Ischemic therapeutic compression, e.g. static pressure, to the trigger point is one of the most effective therapies to reduce this focus of hyper irritable tissue over time, releasing it and the symptoms it causes. These symptoms include, but not restricted to, local pain, referral pain to other areas, restricted movement, loss of range of motion and weakness. These myofascial trigger points according to literature result from or are irritated by acute and chronic trauma, overuse, postural faults or stress.

Various inventions have been designed for self-care by patients through self-massage of these myofascial trigger points. For instance, one product discloses a cane like structure, having a hook-shaped end. A similar product is one that is shaped like a huge "S", called The Original "Backnobber" II (U.S. Pat. No. D403,431). The user of these products reaches the product behind their person and, using the hooked end, begin massaging the trigger point.

Such products, however, cause the patient to tense up muscles to operate the device. The products may also be unusable by patients with arthritis and other such disabilities. Moreover, tensing of the muscles is intuitively counterproductive to the relaxation of the muscles needed to remove myofascial trigger points and may actually exacerbate other pre-existing trigger points or cause new trigger points. Accordingly, these devices have limited ability to produce the intended results.

Another product is a hand held device which has dowels inserted into a hand-sized main portion. The ends of the dowels are capped with spheres. The device looks much like a bug with a round body with fixed appendages. A health care provider holds the device, while pressing and sliding the device across the tissue to be treated. The patient can attempt to use the device by laying it on the floor, positioning their body above it and leaning their body against it to apply pressure. This device has substantial flaws related to size restrictions, lack of interchangeability and adaptability of treatment appendages, all limiting the applicability of this device. For instance, the size and length of the ball-capped dowels are not interchangeable, limiting the tissue and locations which can be treated with the device. A similar product looks like a child's "jack", the Original "Jacknobber" (U.S. Pat. No. D377,100), is used in the same way with the same limitations, when compared to the myofascial rehabilitation board.

U.S. Pat. No. 4,233,966 (issued Nov. 18, 1980 to Takahashi) discloses a board with round knobs that can be moved between preselected locations on a board for acupressure of acupressure points. However, each of the knobs of this device are of the same length, diameter, and 90° angle to the board, preventing the device from providing any variation of depth or angle of therapeutic pressure. Therefore, with each of the knobs being of the same length, the device is suitable for treating acupressure points of only one superficial depth.

A body contour massage device (U.S. Pat. No. 5,820,573 issued Oct. 13, 1998) is a device designed to "apply simultaneous pressure to a persons complete body contour as therapy for people with excessive spinal curvature." This device is designed to treat the entire paraspinal contour with 90° projections, without the ability to specifically treat involved myofascial tissue with trigger points throughout the human body.

What is needed is a myofascial rehabilitation board that is stable and selectively presents the projections at a variety of angles to provide for stretching of the tissue and the simultaneously compressively treating myofascial trigger points throughout the human body including the back. Therefore, in contrast to other devices, a device should have projections that come in a variety of lengths, diameters, and angles to comfortably reach and effectively treat the trigger point with ease, regardless of the location within the body.

SUMMARY OF THE INVENTION

The present myofascial rehabilitation device is provided with a board, projections, tips, and a mechanism for retaining the projections. More specifically, the board defines a handle and bores therein. The bores may be of predetermined diameters ranging between ¼" to 1½". The bores may be of predetermined orientations, ranging from 30° to 90° relative to a surface of the board in combination and predetermined patterns.

The projections have first and second ends. The first end of each projection may being selectively engageable within the bores. The projections preferably are of predetermined diameters ranging in from ¼" to 1½" and ranging in length from 1" to 4" or more.

Tips may be sized to snugly receive the second end of the projections. The tips should be sufficiently shaped or compressible to provide therapeutic advantage and comfort between the tip and the patient's body. Such tips may be removable or fixed at the behest of the manufacturer.

The mechanism for retaining the projections is used when the projections are disengaged from the board. Such mechanism may be a bag, clip or other feature for retaining the components.

The present invention further includes a method of using the board including the steps of pre-stretching tissue to be treated; arranging at least one projection on a myofascial rehabilitation board; relaxing against the board such that the projection applies ischemic compression therapy to an involved trigger point, such pressure to be applied until there is tolerable local discomfort and moderate duplication of the referral pain pattern for that trigger point, while avoiding tensing of the myofascial tissue. The patient then applies more pressure as local and referral discomfort abates to maintain mild referral discomfort; and ceasing the treatment when the referral discomfort abates and the trigger point releases.

Advantageously, the present invention provides a stable inexpensive piece of equipment that allows a patient to treat themselves under the supervision and instruction of a trained health care provider.

As a further advantage, the present invention provides a method of treatment that does not require the patient to contract and fatigue their muscles as part of the process of applying this therapeutic device in rehabilitation of their myofascial trigger points, thereby avoiding exacerbation of pre-existing active and latent trigger points in the patient, or the creation of new trigger points.

As yet another advantage, the device is easily adjusted so as to be able to treat myofascial tissues of different depths, angles and different locations on patients of a variety of different body shapes and sizes.

As still yet another advantage, the present invention is compact and does not require substantial floor space to use or store.

Further, the present invention is adapted to allow for treatment of several patients within the confines of a single clinical room simultaneously, if used in a clinical setting. The use of this device is applied passively by the patient, thereby preventing provider fatigue and injury.

Also advantageously, operative force for use of the device or method, being passive, does not exhaust the patient, allowing the patient to fully relax, increasing treatment efficacy, decreasing treatment times, and decreasing recovery period for the myofascial and fibromyalgia conditions.

DETAILED DESCRIPTION

Figure 1:
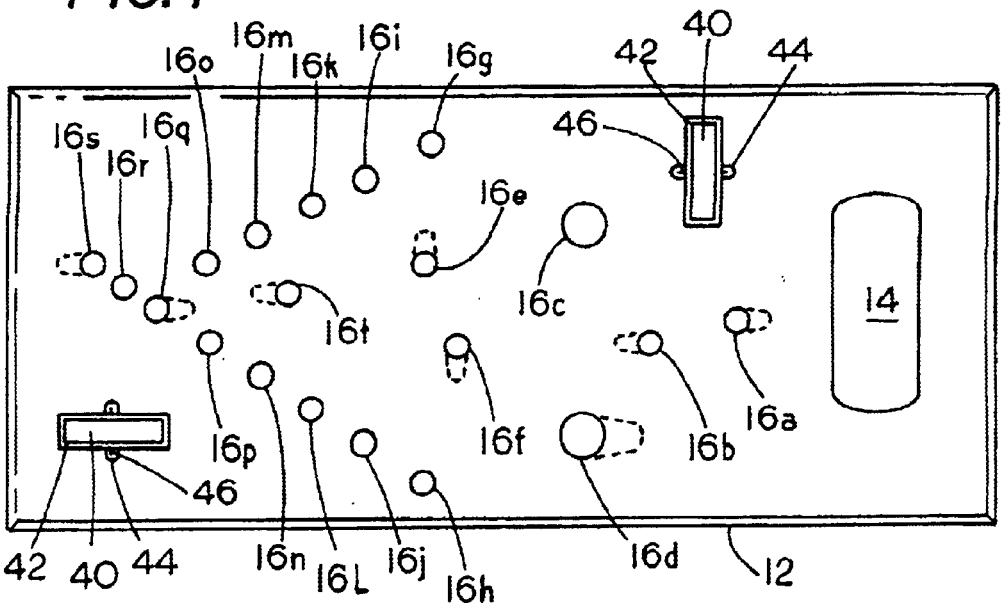
FIG. 1 is a top view of the board of the present invention.

The myofascial rehabilitation device 10 of the present invention includes a board 12, projections 20, a mechanism for retention 30 and a therapeutic wheel 40. These components and the method of using the same follows.

The board 12 may define a handle 14 and bores 16 therein. The board 12 may be made of a variety of materials selected based upon strength, ease of manufacture and cost. Suitable materials include hardwood and plastic. The board 12 may be any suitable size and shape, but preferably formed of a hardwood approximately 18"×8"×1" in size. The board 12 may have a non-skid undersurface to hold the board 12 still when in use.

The bores 16*a–t* may be of a predetermined diameters ranging between ¼" to 1½" with a preferred diameter of ½", except as specified below. The bores 16*a–t* should be of sufficient size and depth to snugly receive and support projections 20 therein. The bores 16*a–t* may be of predetermined orientations, patterns and angles, ranging from 30° to 90° relative to a surface 13 of the board 12. For instance, bores 16*a* and 16*b* are designed to optionally operate in tandem with both bores angled at perhaps 60°. Projections 20 disposed in bores 16*a* and 16*b* stretch the tissue of a patient around a trigger point.

Bores 16*c* and 16*d* are designed to support a large diameter projection 20. Bores 16*c* is disposed 90° relative to the surface 13 of the board 12, while bore 16*d* may be disposed at a manufacturer determined angle, preferably 55°.

Bores 16*e* and 16*f* operate similar to bores 16*a* and 16*b*. Bores 16*e*, 16*f* as a pair are rotated 90° with respect to bores 16*a*, 16*b* for ease of orientation of the board 12, when in use. Bores 16*e*, 16*f* may be of a diameter different from 16*a*, 16*b*.

Pairs of bores 16*g*, 16*h*; 16*i*, 16*j*; 16*k*; 16*l*; 16*m*; 16*n*; 16*o* and 16*p* are preferably vertically oriented at 90° to the surface of the board and are paired at different distances as shown. Such bores 16*g*–16*p*, in operation with projections 20 are designed specifically to be used in the area of spinal column. The varying widths allows for adjustment of the present invention 10 to the width of the paraspinal muscles of the vertebra of a variety of patients, and to accommodate the differing size of the spine at different locations of the spinal column in the same patient.

Bores 16*q–s* are adapted to operate together. Bores 16*q*, 16*s*, preferably disposed at 55°, in combination with projections 20 stretch the tissue to be treated, while bore 16*r*, disposed at 90°, in combination with a projection 20 applies a compressive force to the specific trigger point.

Bore 16*t* is highly angled at 30° to specifically treat areas of the body that demand this approach to reach the myofascial trigger point. For instance, trigger points in the upper trapezius muscle or the hip are in the tensa fascia lata tend to need highly angled projections 20 to properly address the trigger point.

Figure 2:
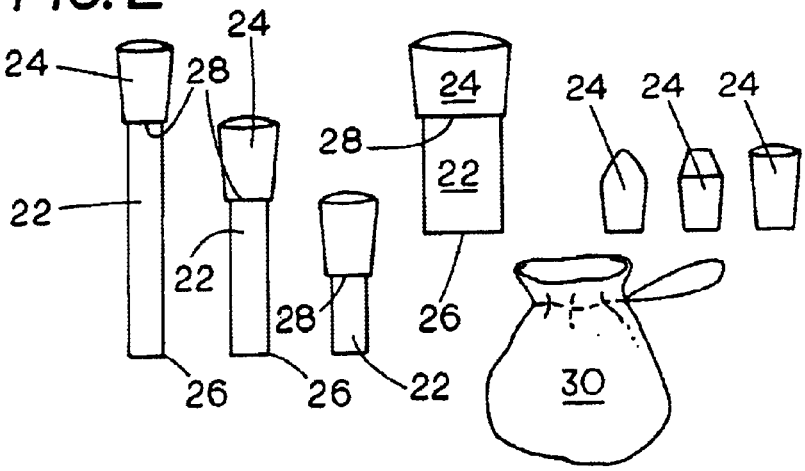
FIG. 2 is a side view of the mechanism for retention and various projections.
Figure 3:
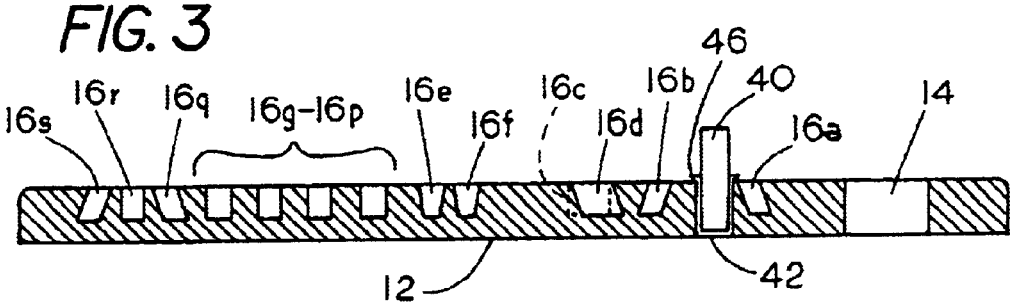
FIG. 3 is a cross sectional view of the board of the present invention taken along the lines 3—3 of FIG. 1.

The projections 20 may have a stem 22 and a tip 24, the stem 22 having a first end 26 and a second end 28. The first end 26 of each projection 20 may be selectively engageable within the bores 16*a*–16*t*. The projections 20 preferably are of predetermined diameters ranging in from ¼" to 1½" and range in length from one inch to four inches as shown in FIG. 2. Varying diameters and lengths allow the health care provider to work on tissue of varying rigidity, depths and sizes of affected areas.

The second end 28 is selectively, permanently or homogeneously joined to the tip 24. Tips 24 may be sized to snugly receive the second end 28 of the projections 20. The tips 24 may be compressible or hard. The tips 24 should be of such construction as to not cut or scratch the skin overlying the tissue being treated. The tips 24 may also be designed in different therapeutic shapes so as to specifically treat the trigger points of different tissues and locations. For example, the tips 24 may be rounded, wedge or conically shaped.

The mechanism 30 for retaining the projections 20 when the projections 20 are disengaged from the board 12 may be any suitable device for holding the projections 20. Shown in FIG. 2 is mechanism 30 in the form of a bag with a draw cord. Other devices such as clips, compartments, or other retaining devices are also suitable. The retaining mechanism 30 may be selectively, permanently, or homogeneously joined to the board 12.

The board 12 may also include at least one wheel 40. The wheel 40 may be disposed in a groove 42 and an axle slot 44. The axle 46, which passes through the disc 48, is positioned in the axle slot 44. The disc and groove are of such comparable dimensions that the wheel 40 can turn as a patient lays the myofascially involved tissue against the wheel 40 and rolls the tissue across wheel 40. A pair of wheels 40 are show in FIG. 1 oriented perpendicular to each other for ease of access.

The method of treatment with the myofascial rehabilitation board 10 can include, but not be limited to, the amelioration of acute and chronic myofascially induced pain, the recovery of joint flexibility and the improvement of range of motion, improved physical performance, and the treatment of myofascial conditions arising out of accidents and injuries. The invention 10 is beneficial when the patient has been diagnosed with trigger points related to musculoskeletal problems such as fibrositis, tendonitis, bursitis, arthritis, chronic neck pain and headaches, chronic backaches, Myofascial Pain Syndrome, or fibromyalgia syndrome. The method may include the steps of arranging at least one projection 20 on a myofascial rehabilitation board 20. Different projections 20 may be selected based upon location, density or thickness and depth of the tissue to be treated. The projection(s) 20 are inserted into bores 16 defined in the board 12 at a desired angle.

Next, the patient relaxes against the board 12 such that the projection(s) 20 applies pressure, preferably ischemic compression therapy, to a trigger point. A trigger point is a focus of hyper irritable myofascial tissue in any area of a patients body that spontaneously or with applied pressure refers pain and tenderness to other areas of a patient's body. A trigger point may be in muscle tissue, fascia of muscle, cutaneous, ligamentous, periosteal, and non-muscular fascial tissues. A plurality of trigger points may be present. Types of trigger points treatable with this invention include active, latent, primary, associated, satellite and secondary trigger points.

The ischemic pressure is to be applied with the myofascial rehabilitation board 10 until there is tolerable discomfort, while avoiding tensing of the tissue. More pressure is applied as local and referral discomfort abates in the involved trigger point being treated. That is, the patient maintains mild local and referral discomfort. The pressure typically is sustained between 10 and 35 pounds per projection 20, depending on the patients build and tolerance. The patient stops when the trigger point releases.

The patient may also apply therapeutic transfrictional massage to the involved trigger point while under mild ischemic compression with the myofascial rehabilitation board 10. This is accomplished by a slight back and forth motion across the trigger point, while the therapeutic projection 20 compresses the tissue.

Further the muscle may be "stripped", using the myofascial rehabilitation board 10. "Stripping" is a known massage technique, whereby the involved tissue with the associated trigger point is worked over the projection 20 in a sliding motion extending between 2" and 6" or more to strip out the involved myofascial tissue. Pressure is increased between the trigger point and the projection 20. Each pass should be at a therapeutic speed. Commonly the rate of movement is approximately one inch about every four seconds. When used in this manner, the projection 20 preferably may be lubricated and preferably has a diameter of approximately one inch.

Although the present invention has been described with reference to preferred embodiments, workers skilled in the art will recognize changes may be made in form and detail without departing from the spirit and scope of the invention. For instance, the patient or health care provider may also have the tissue to be treated pre-stretched or post stretched. Further, the tissue may be moist heat packed adjacent the trigger point prior to, during and/or after treatment with use of the board 12. The patient or care provider may apply lubricant, herbal patch, herbal lotion or other medication to the projection 20, which is selectively joined to the board 12.

I claim:

1. A myofascial rehabilitation device, comprising:

a board defining a handle and bores therein, the bores being of multiple diameters of various sizes ranging between ¼" to 1½", the bores being of multiple predetermined orientations relative to a surface of the board adjacent the respective bores, ranging from 30° to 90°;

projections having first and second ends, the first end of each projection being selectively engageable within the bores, the projections being of multiple predetermined diameters ranging in from ¼" to 1½" and being of multiple predetermined lengths from one inch to four inches;

tips being sized to snugly receive the second end of the projections; and means for retaining the projections when the projections are disengaged from the board.

2. The device of claim 1 wherein at least one projection is engaged with the board.

3. The device of claim 2 wherein a plurality of projections are engaged with the board.

4. The device of claim 3 wherein a plurality of projections are adapted and acutely angled to stretch a trigger point.

5. The device of claim 3 wherein a plurality of projections are adapted and acutely angled to stretch a trigger point, while another projection, disposed at 90° to the surface of the board, is adapted to apply compressive force.

6. The device of claim 1 wherein the projections are dowels of varying lengths and diameters.

7. The device of claim 1 wherein the retaining means is securable to the board.

* * * * *